US005414921A

United States Patent [19]

Waldebjer

[11] Patent Number: 5,414,921

[45] Date of Patent: May 16, 1995

[54] METHOD AND APPARATUS FOR SIMULTANEOUSLY RIVETING

[75] Inventor: Bo Waldebjer, Blomstermåla, Sweden

[73] Assignee: Press & Platindustri AB, Oskarshamn, Sweden

[21] Appl. No.: 133,136

[22] PCT Filed: Apr. 14, 1992

[86] PCT No.: PCT/SE92/00242

§ 371 Date: Oct. 13, 1993

§ 102(e) Date: Oct. 13, 1993

[87] PCT Pub. No.: WO92/18265

PCT Pub. Date: Oct. 29, 1992

[30] Foreign Application Priority Data

Apr. 19, 1991 [SE] Sweden ..... 9101179

[51] Int. Cl.[6] ..... B21J 15/02; B21J 15/36

[52] U.S. Cl. ..... 29/524.1; 29/34 B; 29/243.54; 29/525.2

[58] Field of Search ..... 29/243.53, 243.54, 522.1, 29/509, 524, 524.1, 525.2, 34 B, 512; 72/381, 384, 399, 400, 404, 405; 227/43, 51, 52, 55, 56

[56] References Cited

U.S. PATENT DOCUMENTS

| | | | |
|---|---|---|---|
| 2,654,272 | 10/1953 | Warren | 29/525.1 |
| 2,925,748 | 2/1960 | Ross | 29/243.54 |
| 3,543,985 | 12/1970 | Adolphi | 227/51 X |
| 4,221,041 | 9/1980 | Hufnagl et al. | 29/524.1 X |
| 4,864,713 | 9/1989 | Roberts et al. | 29/525.2 X |

FOREIGN PATENT DOCUMENTS

| | | |
|---|---|---|
| 337080 | 5/1921 | Germany . |
| 712305 | 7/1954 | United Kingdom . |
| 1215821 | 3/1986 | U.S.S.R. . |

*Primary Examiner*—Peter Dungba Vo
*Attorney, Agent, or Firm*—Young & Thompson

[57] ABSTRACT

Process for riveting together sheet metal, using a riveting tool (1) with a central partially spherical raised portion (8) in its pressing surface, which when pressed against the rivet shaft end (10) causes the rivet shaft to swell radially before a second rivet head is formed of the material in the river shaft.

4 Claims, 1 Drawing Sheet

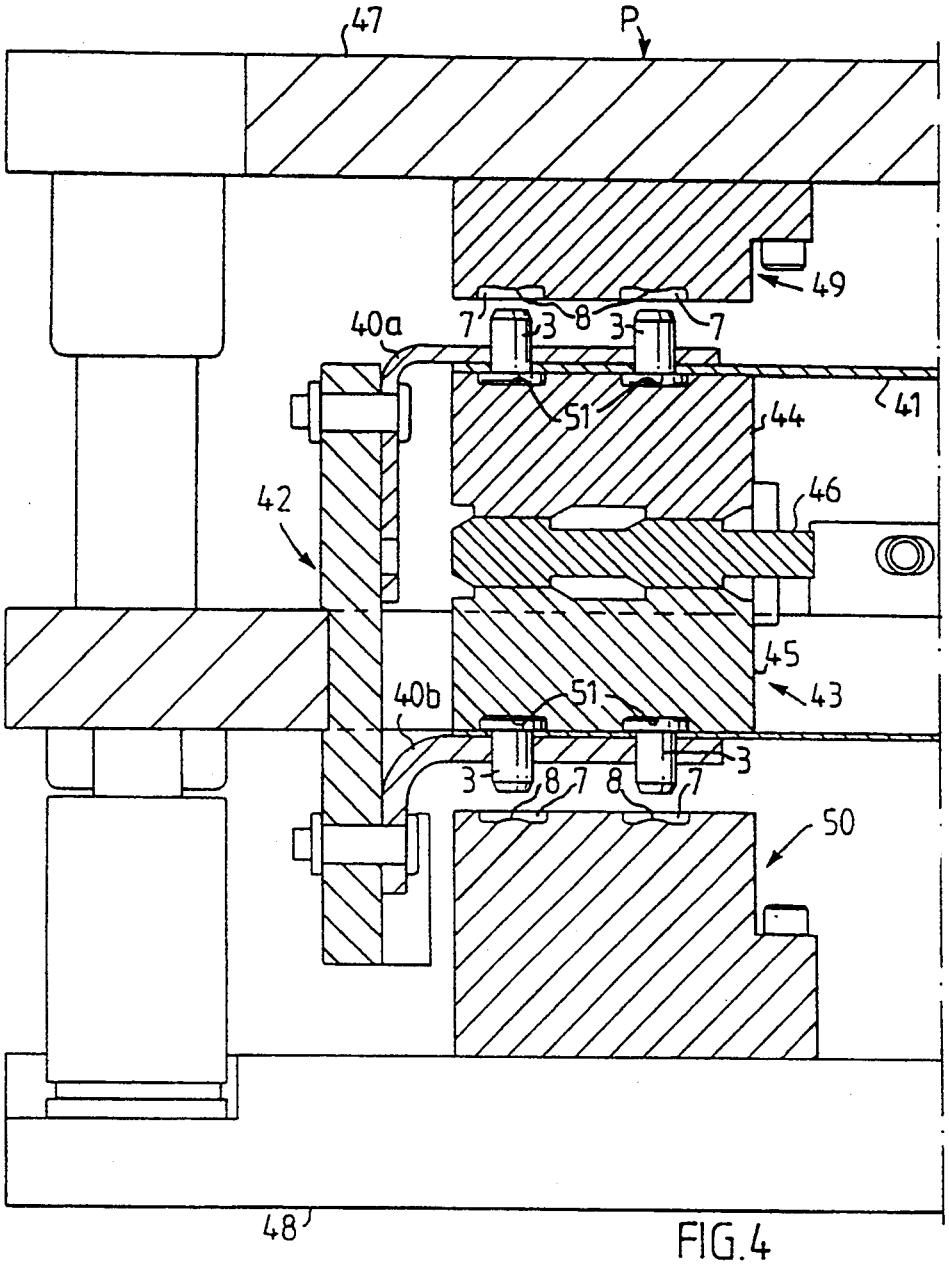
FIG.4
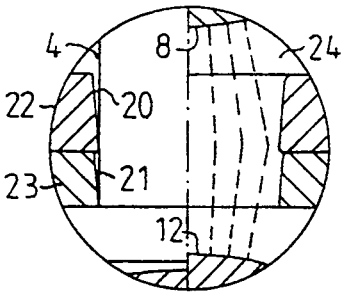
FIG.3
FIG.2
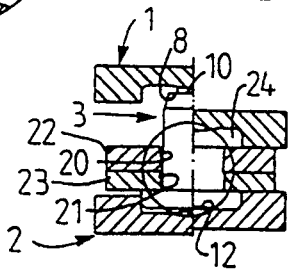
FIG.1
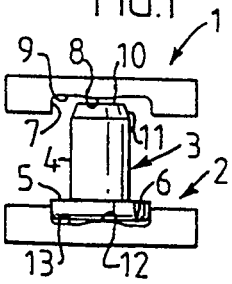

METHOD AND APPARATUS FOR SIMULTANEOUSLY RIVETING

FIELD OF THE INVENTION

The present invention relates to a process for riveting together objects, in which a rivet with a head and a rivet shaft is inserted with its rivet shaft into holes in the object, whereafter the rivet is compressed between a riveting tool and a holder-on, so that a second rivet head is formed on the side of the objects opposite to the side on which the first-mentioned head is located.

The invention also relates to a tool for carrying out said process.

BACKGROUND OF THE INVENTION

In conventional yoke riveting with homogenous rivets, the rivet is compressed between a pair of flat surfaces on the riveting tool and on the holder-on. The deformation essentially reshapes the free end of the rivet shaft extending out from the objects into its second rivet head. This means that the diameter of the rivet shaft must be carefully adapted to the diameter of the holes in the objects so that there will be no gap in the rivet fastening. When fastening together objects of varying thicknesses, rivets of varying lengths must be used. This places requirements of the skill of the riveter and involves a risk of faults especially when there is very little difference in length between the different rivets to be used. The need to use rivets of varying lengths also means that it is not possible to rivet several rivets at the time with the same tool. Rather, the rivets must be compressed one at the time or with a number of rivet yokes at the same time.

The risk of gaps arising in a rivet fastening between for example a pair of sheet metal pieces is greater in those cases where the holes have been punched in the sheet metal pieces than when they have been drilled since punched holes will always be slightly conical with a smaller diameter at the entry side of the punch and the larger diameter on the die side.

SUMMARY OF THE INVENTION

The purpose of the present invention is to provide a riveting process and a tool making it possible to use rivets of a single length and diameter for various thicknesses and hole diameters within a certain thickness interval of sheet metal combinations which are to be riveted together.

This is achieved according to the invention in a process of the type described by way of introduction by virtue of the fact that the rivet is compressed between a riveting tool and a holder-on creating a force pattern in the rivet shaft, which strives to expand the rivet shaft radially in connection with the forming of the other rivet head.

A tool for carrying out the riveting process is characterized in that at least the riveting tool has a pressing surface with a central raised portion surrounded by a flat angular portion.

By using a tool which causes the rivet shaft to swell before the head is formed, a single dimension of rivet can be used for varying hole diameters, since the initial deformation of the rivet results in a radial filling of the hole. This in turn means that a single rivet link can be used for different thicknesses of rivet fastenings by virtue of the fact the required amount of material for the rivet head can be controlled by adjusting the hole diameter, i.e. a large diameter rivet hole is provided when the combined thickness of the objects to be fastened together is small.

Thus the need in production to select rivets of varying lengths within a certain interval is eliminated and a number of rivets can be compressed in a pressing operation with a single tool.

BRIEF DESCRIPTION OF THE DRAWINGS

The invention is described in more detail with reference to examples shown in the accompanying drawings, where FIG. 1 shows a rivet between a schematically shown riveting tool and a holder-on, FIG. 2 shows a section through the tool components in FIG. 1 prior to and after riveting of a pair of sheet metal pieces, FIG. 3 is an enlargement of the encircled area in FIG. 2 and FIG. 4 is a cross section through an apparatus for riveting together a U-beam with tie plates.

DETAILED DESCRIPTION OF THE INVENTION

In FIGS. 1–3, 1 designates a riveting tool and 2 a holder-on for counterhold, between which a homogenous steel rivet 3 is placed. The rivet 3 has a shaft 4 and a head 5, which is disposed in a depression 6 in the holder-on 2. The riveting tool 1 has a corresponding depression 7. In the center of the depression 7 there is an essentially partially spherical raised portion 8, which is surrounded by a flat annular bottom surface 9 in the depression 7. The raised portion 8 is located directly opposite the end surface 10 of the rivet shaft and has a diameter approximately equal to the diameter of the end surface 10, i.e. approximately 15–20% less than the diameter of the shaft 4, since the shaft has a conical end portion 11. In the example shown in FIG. 1, there is a depression in the holder-on 2 as well as a raised portion 12 corresponding to the raised portion 8 in the riveting tool 1 and a surrounding annular flat surface 12. The raised portions 8 and 12 respectively have a height above the respective plane surfaces 9 and 13 respectively which amounts to about 5% of the respective diameter. In the example shown, the depressions 6 and 7 have a diameter of 28 mm and the rivet shaft has a diameter of 16 mm. The maximum height of the raised portions is then 0.7 mm and the maximum diameter is 13 mm.

In FIGS. 2 and 3, a rivet 3 is shown in holes 20,21 in a pair of sheet metal pieces 22,23. The holes 20,21 are punched as can be seen from the conical cut. The sheet metal pieces are laid with the smooth side of the holes facing downwards and the rupture zone upwards. An alternative which assures a somewhat greater extent a maximum filling of the holes with the rivet material is to place the sheet metal pieces with the rupture zone of the holes facing each other. To the left in FIGS. 2 and 3, the riveting components 1 and 2 are shown prior to compression and to the right in these Figures after compression. During compression, a force pattern arises, which is indicated by the dashed lines in FIG. 3. The result of this is that the material in the rivet shaft swells (expands radially) and completely fills the holes 20,21 before the shaft 4 has formed a second head 24 on the side of the sheet metal pieces 22,23 opposite to the head 5.

In tests performed, a single dimension of rivet (length/diameter) was used for sheet metal combinations with a combined thickness from 10 mm to 14 mm. Hole punches with diameters from 19 mm for holes in sheet metal combinations with the smallest thickness down to 17.5 mm for holes in sheet metal combinations with the greatest thickness. When riveting using the method described, a depression was formed in each rivet head.

FIG. 4 shows one half of a riveting apparatus for riveting tie plates 40*a* and 40*b* to a U-beam 41. The components 40*a, b* and 41 can for example be components in a truck chassis frame. The tie plates 40*a, b* are held in position by a fixture 42 and hold between them at the same time the U-beam 41. Rivets 3 extend through holes in components 40*a, b* and 41 and are kept in place by a two-part holder-on or counterhold 43, the components 44, 45 are pressed securely against the U-beam by a wedge 46. On a pair of bridges 47, 48 which can be moved towards each other, upper and lower riveting tools 49 and 50 respectively are fixed. The riveting tools 49, 50 are made in the manner described above with a depression 7 with a central raised portion 8. In contrast to the counterholds described above, the counterholds 43 are made with completely flat depressions 51 and no raised portions corresponding to the raised portions 8 since in most cases it has proved sufficient to provide the riveting tool which presses against the shaft end with a raised portion 8.

The apparatus described here is placed between a fixed surface and a pressing tool in a pressing machine (not shown). When pressure is applied to the upper bridge 47 it is moved downwards so that the end surfaces of the rivet shafts 4 of the upper rivets 3 come into contact with the raised portions 8 of the upper riveting tool 49. As the movement of the upper bridge continues downwards, the fixture 42 is moved down until the end surfaces of the lower rivets 3 come into contact with the raised portions 8 of the lower riveting tool. There is then a compression of the rivets in a single operation according to the pattern described above in connection with FIGS. 1–3. As can be seen in FIG. 4, the lower tie plate 40*b* is thicker than the upper tie plate 40*a*. The upper and lower rivets 3 are however of the same length, and this means that all of the rivets can be riveted in one operation at the same time as the risk of selecting the wrong rivet length is eliminated.

The invention has been described above with reference to a raised portion 8 of partially spherical shape, but it is also conceivable within the scope of the invention to use shapes which deviate somewhat from the purely spherical. It is essential that the raised portion has such a shape that the end of the rivet shaft comes into contact with a small contact surface which gradually grows as the rivet is deformed to create an obliquely outwardly directed force pattern in the rivet shaft.

I claim:

1. In a process for riveting together a plurality of objects with at least two rivets, each rivet having a first rivet head, a rivet shaft, and a rivet shaft end, wherein the rivet is inserted with its rivet shaft into a pair of aligned holes in the objects, whereafter the rivet is compressed between a riveting tool and a counterhold, so that a second rivet head is formed on the rivet shaft end, the improvement which comprises inserting at least two rivets into holes of the objects wherein each rivet is inserted into a pair of aligned holes, simultaneously compressing said at least two rivets in the same pressing operation between a riveting tool and counterhold, said riveting tool having at least two depressions corresponding with said at least two rivet shaft ends, each of said depressions having a single pressing surface with a central raised portion surrounded by a circular flat surface, said raised portion having a small contact surface which initially presses against a small central surface of each rivet shaft end, and then gradually, during expansion of each rivet shaft, increases its contact surface against each rivet shaft, and creating a force pattern in the rivet shafts, sufficient to expand the rivet shafts radially and form the second rivet heads whereby the objects are riveted together.

2. Process according to claim 1, wherein each central raised portion is partially spherical.

3. A tool for riveting together a plurality of objects with at least two rivets into holes of the objects, wherein each rivet has a first rivet head, a rivet shaft, and a rivet shaft end, wherein each rivet is inserted with its rivet shaft into a pair of aligned holes in the objects, whereafter each rivet is simultaneously compressed in the same pressing operation between a riveting tool and a counterhold, so that a second rivet head is formed on each rivet shaft end, said riveting tool comprising at least two depressions corresponding with said at least two rivet shaft ends, each of said depressions having a single pressing surface with a central raised portion surrounded by a circular flat annular portion, said raised portion having a small contact surface which initially presses against a small central surface of each rivet shaft end, and then gradually, during expansion of each rivet shaft, increases its contact surface against each rivet shaft, and said pressing operation creating a force pattern in the rivet shafts, sufficient to expand the rivet shafts radially and form the second rivet heads whereby the objects are riveted together.

4. Tool according to claim 3, wherein the raised portion is partially spherical and has a diameter approximately 15–20% less than the diameter of the rivet shaft for which the tool is intended, and wherein the maximum height of the raised portion above the flat annular portion is approximately 5% of its diameter.

* * * * *